US007503754B2

(12) United States Patent
Okii et al.

(10) Patent No.: US 7,503,754 B2
(45) Date of Patent: Mar. 17, 2009

(54) CONTROL VALVE FOR VARIABLE CAPACITY COMPRESSOR

(75) Inventors: Toshiki Okii, Tokyo (JP); Yoshiyuki Kume, Tokyo (JP); Toru Watanuki, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 723 days.

(21) Appl. No.: 10/817,842

(22) Filed: Apr. 6, 2004

(65) Prior Publication Data

US 2004/0202552 A1 Oct. 14, 2004

(30) Foreign Application Priority Data

Apr. 9, 2003 (JP) ..... 2003-105652
Mar. 3, 2004 (JP) ..... 2004-059372

(51) Int. Cl.
*F04B 1/26* (2006.01)
*F16K 51/00* (2006.01)
*F16K 31/02* (2006.01)
*F04B 1/08* (2006.01)

(52) U.S. Cl. ..... 417/222.2; 251/117; 251/129.07

(58) Field of Classification Search ..... 417/222.2; 251/129.07, 117

See application file for complete search history.

(56) References Cited

U.S. PATENT DOCUMENTS 4,630,770 A * 12/1986 Sliger et al. ..... 236/34.5
5,332,365 A * 7/1994 Taguchi ..... 417/222.2
6,062,824 A * 5/2000 Kimura et al. ..... 417/222.2
6,217,290 B1 * 4/2001 Imai et al. ..... 417/222.1
6,340,293 B1 * 1/2002 Bona et al. ..... 417/307

FOREIGN PATENT DOCUMENTS

JP 2002-303262 A1 10/2002

* cited by examiner

*Primary Examiner*—Devon C Kramer
*Assistant Examiner*—Philip Stimpert
(74) *Attorney, Agent, or Firm*—Rader, Fishman & Grauer, PLLC

(57) ABSTRACT

In a control valve for a variable capacity compressor, coolant that is sucked in from a suction chamber through a suction conduit is compressed and delivered to a delivery chamber through a delivery conduit and the coolant pressure is controlled by an electromagnetic control valve. Opening/closing control of a gas supply valve body (gas supply side) that communicates with the delivery conduit and a crank chamber and of an extraction valve body (extraction side) that communicates with the crank chamber and the suction conduit is performed in accordance with the suction coolant pressure of the suction conduit. A crank chamber communication port communicates with the extraction valve chamber.

2 Claims, 9 Drawing Sheets

CONTROL VALVE FOR VARIABLE CAPACITY COMPRESSOR

BACKGROUND OF THE INVENTION

1. Field of the Invention

The present invention relates to a control valve of a refrigeration cycle employed in a variable capacity compressor, and in particular relates to a control valve for a variable capacity compressor that controls supply of coolant gas into a crank chamber from a delivery pressure region as required and to discharge of coolant gas into a suction-side region in the crank chamber.

2. Description of the Related Art

Since the compressor that is employed in the refrigeration cycle of an air conditioner for an automobile is directly coupled with the engine by means of a belt, it is not possible to control the speed of rotation thereof. A variable capacity compressor is therefore employed whose compression capacity (delivery rate) can be altered in order to obtain an appropriate cooling capability without being influenced by the rotational speed of the engine.

This variable capacity compressor typically has a construction in which coolant that is drawn in from a suction chamber communicating with a suction conduit is compressed and delivered into a delivery chamber communicating with a delivery conduit and in which the delivery rate of coolant is changed by change of coolant pressure of a pressure-regulated chamber (crank chamber) that is subjected to coolant pressure control by means of a control valve. Japanese Patent Application Laid-open No. 2002-303262 discloses a control valve for a refrigeration cycle that controls the coolant pressure Pc of a crank chamber by producing a flow (gas suction) of delivered coolant from a delivery conduit passage (delivered coolant pressure Pd) into the crank chamber (crank chamber coolant pressure Pc) by opening/closing a valve arranged on the gas suction side, in accordance with the coolant pressure balance of the suction coolant pressure Ps of a variable capacity compressor and the reaction of a bellows. Regulation of the crank chamber coolant pressure Pc of the variable capacity compressor can be achieved by this means.

However, in regulatory control of the crank chamber coolant pressure Pc of the aforesaid variable capacity compressor, there are limitations on the response thereof in that for example a prescribed time is required from when a fluctuation of the suction coolant pressure Ps takes place until completion of control. Realization of a control valve having a function wherein response is further improved is therefore desired.

SUMMARY OF THE INVENTION

An object of the present invention is to realize a control valve that can perform control without waste of time or energy by realizing control with an even better response. A further object is to avoid the occurrence of vibration of the extraction valve body caused by the difference in pressure (Pc-Ps) between the crank chamber coolant pressure Pc and the suction coolant pressure Ps.

Yet a further object is to improve durability of the control valve by facilitating processing of the control valve and reducing the effect of coolant temperature on the solenoid exciting section of the control valve.

In a first embodiment of a control valve for a variable capacity compressor according to the present invention, coolant that is sucked in from a suction chamber through a suction conduit is compressed and delivered to a delivery chamber through a delivery conduit and the coolant pressure is controlled by a control valve comprising a solenoid exciting section. This control valve comprises a control valve main body, the solenoid exciting section for controlling coolant pressure in the crank chamber and a pressure-sensitive section. The solenoid exciting section is arranged in a position below the control valve, the pressure-sensitive section is arranged inside this solenoid exciting section and, in addition, the control valve main body is arranged at the top of the solenoid exciting section. Opening/closing control of a gas supply valve body arranged between the delivery conduit and the crank chamber and of an extraction valve body arranged between the crank chamber and the suction conduit is performed in accordance with the balance of the attractive force of the solenoid exciting section, the reaction of bellows and the suction coolant pressure. The control valve main body is a tubular body extending in the vertical direction and is formed in a condition with respective communication effected between a gas supply valve chamber that communicates with a crank chamber communicating port, a gas supply valve hole, a delivery communication port, a valve rod support section, an extraction valve hole communicating with a suction communicating port, and an extraction valve chamber communicating with the crank chamber communicating port, in order from the top to the bottom along an axis within the tubular body thereof. Also, a valve rod that is elongate in the vertical direction is arranged inside the tubular body. This valve rod comprises a gas supply valve body arranged in the gas supply valve chamber, a reduced-diameter section formed at the gas supply valve hole and the delivery communication port, a support receiving section that is supported at the valve rod support section, a stop that is positioned within the extraction valve hole, and an extraction valve body guide section that is positioned within the extraction valve chamber. Furthermore, the extraction valve body is slidably fitted into the interior of the extraction valve body guide section, being biased towards the extraction valve hole, and is located in position by the stop.

The control valve may assume the following form.

The stop is arranged so as to be capable of alteration of vertical position with respect to the valve rod. The control valve is of a construction wherein the minimum flow path area of the extraction valve body can be ensured when the extraction valve body is in the fully closed position. The minimum flow path area of the extraction valve body is ensured by providing a notch in the surface of the extraction valve body opposite to the extraction valve seat. The mutually facing surfaces of the extraction valve body and the extraction valve seat are formed as faces that are perpendicular with respect to the axis of the valve rod.

The force due to the difference between the crank chamber coolant pressure and the suction coolant pressure, respectively acting on the valve rod, is made substantially equal to the force due to the difference between the crank chamber coolant pressure and the suction coolant pressure respectively acting on the extraction valve body. If the cross-sectional area of the interior of the extraction valve guide section of the valve rod is designated as AϕA, the cross-sectional area of the extraction valve hole as AϕB, and the cross-sectional area of the gas supply valve body as AϕC, AϕA, AϕB and AϕC are set such that:

$$A\phi A = A\phi B - A\phi C$$

The extraction valve body guide section of the valve rod is supported by a spring receiving section that is fixed in gas-tight fashion to the control valve main body and an extraction valve-closing spring that biases the extraction valve body in the closing direction is supported by this spring receiving section. The extraction valve body comprises a tubular section that is externally fitted along the interior of the extraction valve body guide section, a larger-diameter section that is formed on the valve seat side of this tubular section and an inclined section that is formed at the periphery of the valve seat side of this larger-diameter section.

In a second embodiment of the control valve for a variable capacity compressor according to the present invention, coolant pressure control is performed by means of a control valve that comprises a solenoid exciting section including a plunger and whereby coolant that is sucked in from the suction chamber through the suction conduit is compressed and delivered into the delivery chamber through the delivery conduit. This control valve comprises a control valve main body, the solenoid exciting section for controlling the coolant pressure within the crank chamber and a pressure-sensitive section. The solenoid exciting section is arranged in a position at the bottom of the control valve, the pressure-sensitive section is arranged inside this solenoid exciting section and, in addition, the control valve main body is arranged at the top of the solenoid exciting section. Opening/closing control of the gas supply valve body arranged between the delivery conduit and the crank chamber and of the extraction valve body arranged between the crank chamber and the suction conduit is performed in accordance with the balance of the attractive force of the solenoid exciting section, the reaction of the bellows and the suction coolant pressure. The control valve main body is a tubular body extending in the vertical direction and is formed with a gas supply valve chamber that communicates with a crank chamber communicating port, a gas supply valve hole, a delivery communication port, a valve rod support section, an extraction valve chamber communicating with the crank chamber communicating port, and a plunger chamber communicating with a suction communicating port, in order from the top to the bottom along the axis, within the tubular body thereof. Also, a valve rod that is elongate in the vertical direction is arranged inside the tubular body. This valve rod comprises a unitary body comprising a gas supply valve body arranged in the gas supply valve chamber, a reduced-diameter section formed at the gas supply valve hole and the delivery communication port and a support receiving section that is supported at the valve rod support section, and an extraction valve body guide section that is unitary with the plunger but separate from the aforesaid unitary body and positioned within the extraction valve chamber. The extraction valve body is slidably fitted into the extraction valve body guide section and arranged biased towards the unitary body side and is located in position by means of an extraction valve plate. In addition, the extraction valve body is formed with a groove that communicates with the suction communication port from the crank chamber communication port and the rate of flow of coolant through the groove is controlled by the vertical position of the extraction valve body with respect to the extraction valve body guide section.

The control valve may assume the following form.

The extraction valve body is formed in pipe shape and the groove is formed as an internal groove and external groove in the inner and outer surfaces of the pipe. Also, the extraction valve body is formed with respective flange-shaped flats at the upper and lower edges of this pipe. The circumferential section of the flat that is formed at the upper edge of the pipe is in sliding contact with the side wall of the extraction valve chamber and the upper surface of the flat that is formed at the lower edge of the pipe is constructed so as to abut the inside wall surface of the suction communication port when the extraction valve is raised.

In a control valve for a variable capacity compressor according to the present invention, with the provision of the above construction, by arrangement of the suction valve body and the extraction valve body and sensing the suction coolant pressure of the variable capacity compressor, the crank chamber coolant pressure on the gas supply side is regulated by allowing coolant in the delivery conduit (delivery coolant pressure) to flow to the crank chamber by operating these two valve bodies, and the crank chamber coolant pressure on the extraction side is regulated by allowing coolant in the crank chamber (crank chamber coolant pressure) to flow out. By introduction of crank chamber coolant to the extraction valve chamber side, the response of the regulatory control of the crank chamber coolant pressure is improved and wasted flow of coolant from the delivery conduit to the crank chamber is reduced, making it possible to improve the efficiency of control. Furthermore, the action of the coolant pressure on the suction valve body is cancelled and the action of the dynamic pressure is reduced, thereby making it possible to suppress vibration of the suction valve body.

According to the present invention, the rate of coolant flow for crank chamber coolant pressure control from the delivery conduit passage (delivery coolant pressure Pd) to the crank chamber passage (crank chamber coolant pressure Pc) can be rapidly increased or decreased. Also, by arranging the stop so that its vertical position with respect to the valve rod can be altered, the valve opening timing of the extraction valve body can easily be altered, so the gas supply valve body also can be optimally tuned.

Also, in opening/closure of the extraction valve body, by arranging for expansion/reduction of the flow path area to be achieved at a stroke, the control action of the variable capacity compressor can be performed rapidly and the construction of the valve rod and plunger can be simplified; in addition, the effect is obtained that vibration of the extraction valve body is not produced.

Furthermore, in the suction valve body, by adopting a shape whereby the action of the coolant pressure is cancelled and the action of the dynamic pressure is reduced, the effect is obtained that vibration of the suction valve body is suppressed. Also, loss of coolant flow can be reduced even though a stop is formed on the valve rod and, in addition, the noise produced by coolant flow can be further reduced.

Also, in a control valve according to a second embodiment of the present invention, there is no need to form a pressure-equalizing hole, so processing of the control valve body is facilitated, making it possible simply to perform processing of the circumferential surface of the extraction valve body, which processing is comparatively easy, so that processing of the control valve is facilitated overall. Furthermore, by separating the position of the delivery communication port from the solenoid exciting section, and arranging the suction communication port in an adjacent position, the effect of coolant temperature on the solenoid exciting section can be reduced.

BRIEF DESCRIPTION OF THE DRAWINGS

The aforesaid and other objects and advantages of the present invention will become apparent from the description of the following embodiments with reference to the appended drawings, in which.

DESCRIPTION OF THE PREFERRED EMBODIMENTS

Embodiment 1

Embodiment 1 of a control valve according to the present invention is described with reference to FIG. 1 to FIG. 4.

First of all, the variable capacity compressor wherein the control valve of embodiment 1 is employed will be described with reference to FIG. 2.

Figure 2:
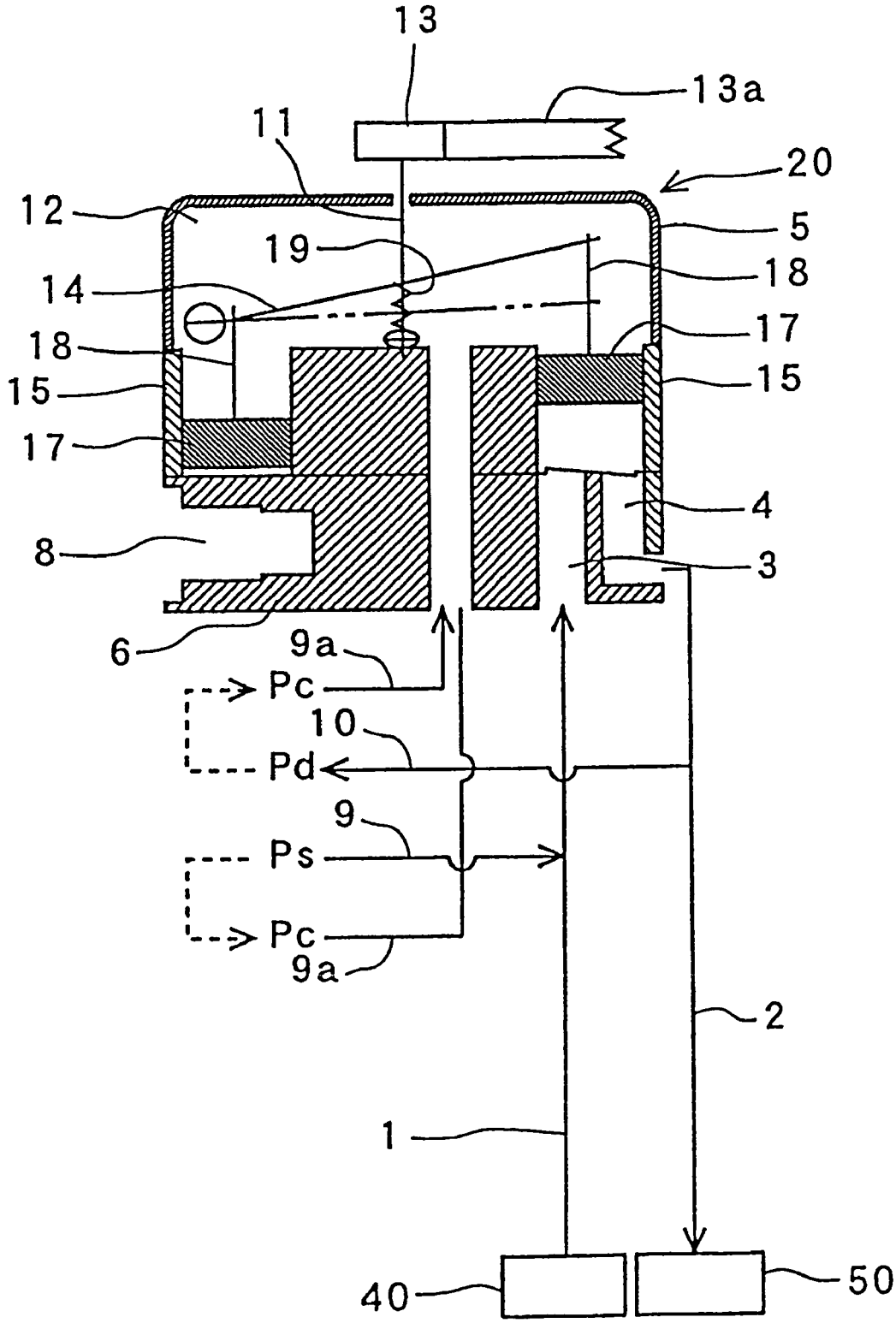
FIG. 2 is a diagram of a variable capacity compressor employing the control valve of FIG. 1.

In FIG. 2, the reference numeral 20 indicates a variable capacity compressor of the inclined plate type, employed for example in a refrigeration cycle for air-conditioning of an automobile. Fluorocarbon gas is employed as the coolant, but application to a refrigeration cycle in which carbon dioxide is employed as the coolant would also be possible. This variable capacity compressor 20 is supported by a front housing 5 and a rear housing 6 integral with this front housing 5.

In FIG. 2, reference numeral 11 indicates a rotary shaft that is arranged within a crank chamber 12 (pressure-regulated chamber) that is constructed in gas-tight fashion. When the rotary shaft 11 is rotated by means of a pulley 13 that is fixed to one end of this rotary shaft 11 being driven by means of a drive belt 13*a*, a rocking plate 14 that is arranged within the crank chamber 12 is rocked by being tilted with respect to the rotary shaft 11. Pistons 17, 17 are arranged in freely reciprocable fashion within cylinders 15, 15 arranged at the circumferential section within the crank chamber 12, the pistons 17, 17 and the rocking plate 14 being linked by means of rods 18, 18.

As a result, when the rocking plate 14 is rocked, the pistons 17 execute reciprocating movement within the cylinders 15, causing low-pressure (suction coolant pressure Ps) coolant to be sucked into the cylinders 15 from the suction chamber 3. This coolant becomes high-pressure (delivery coolant pressure Pd) by being compressed in the cylinders 15 and is delivered into the delivery chamber 4. Coolant is fed into the suction chamber 3 through the suction conduit 1 from the evaporator 40, which is upstream. High-pressure coolant is fed from the delivery chamber 4 through the delivery conduit 2 towards a condenser 50 on the downstream side thereof.

The angle of inclination of the rocking plate 14 changes in accordance with the coolant pressure (crank chamber coolant pressure Pc) within the crank chamber 12; the length of the stroke of the pistons 17 is changed in accordance with the angle of inclination of this rocking plate 14 and the delivery rate of coolant from the cylinders 15 (i.e. the compression capacity) changes accordingly. The delivery rate is larger when the rocking plate 14 is tilted as shown by the solid line and is smaller when the inclination is smaller, as shown by the double-dotted chain line. The delivery rate becomes zero when the rocking plate 14 is perpendicular with respect to the axis of rotation 11. That is, as the rocking plate 14 is gradually shifted into a non-tilted condition (condition approaching the double-dotted chain line), a minimum flow rate holding spring 19 that is mounted so as to surround the rotary shaft 11 is gradually compressed by the rocking plate 14.

As a result, the reaction from the minimum flow rate holding spring 19 to the rocking plate 14 gradually increases, so that the rocking plate 14 cannot flip over before reaching an attitude perpendicular to the rotary shaft 11 and the delivery rate can therefore never become less than for example about 3 to 5% of the maximum delivery rate.

Figure 3:
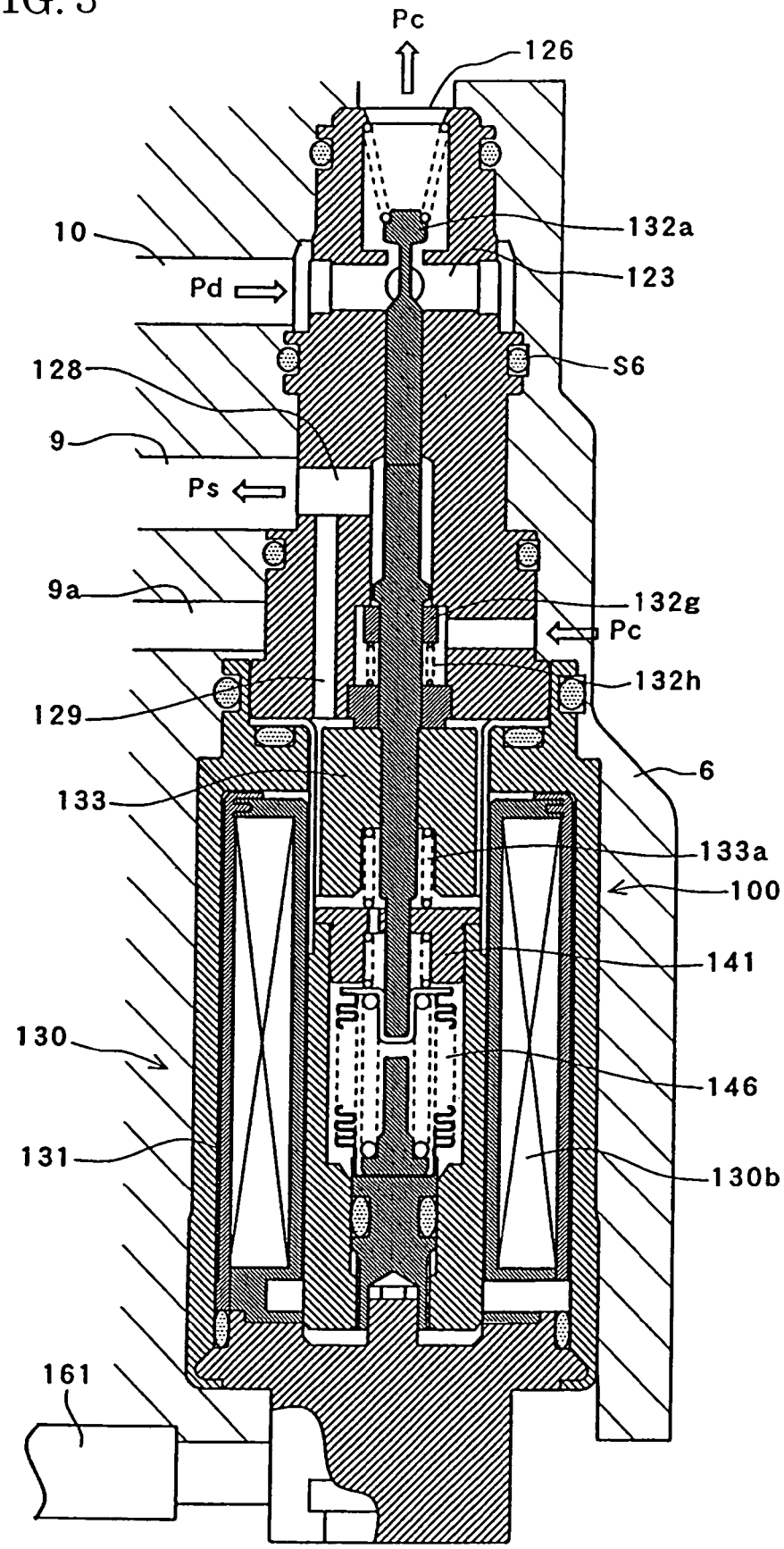
FIG. 3 is an axial cross-sectional view of the control valve of FIG. 1 in which the variable capacity compressor of FIG. 1 is arranged.

Next, a control valve 100 applied to a variable capacity compressor 20 will be described with reference to FIG. 1, FIG. 3 and FIG. 4.

Figure 1:
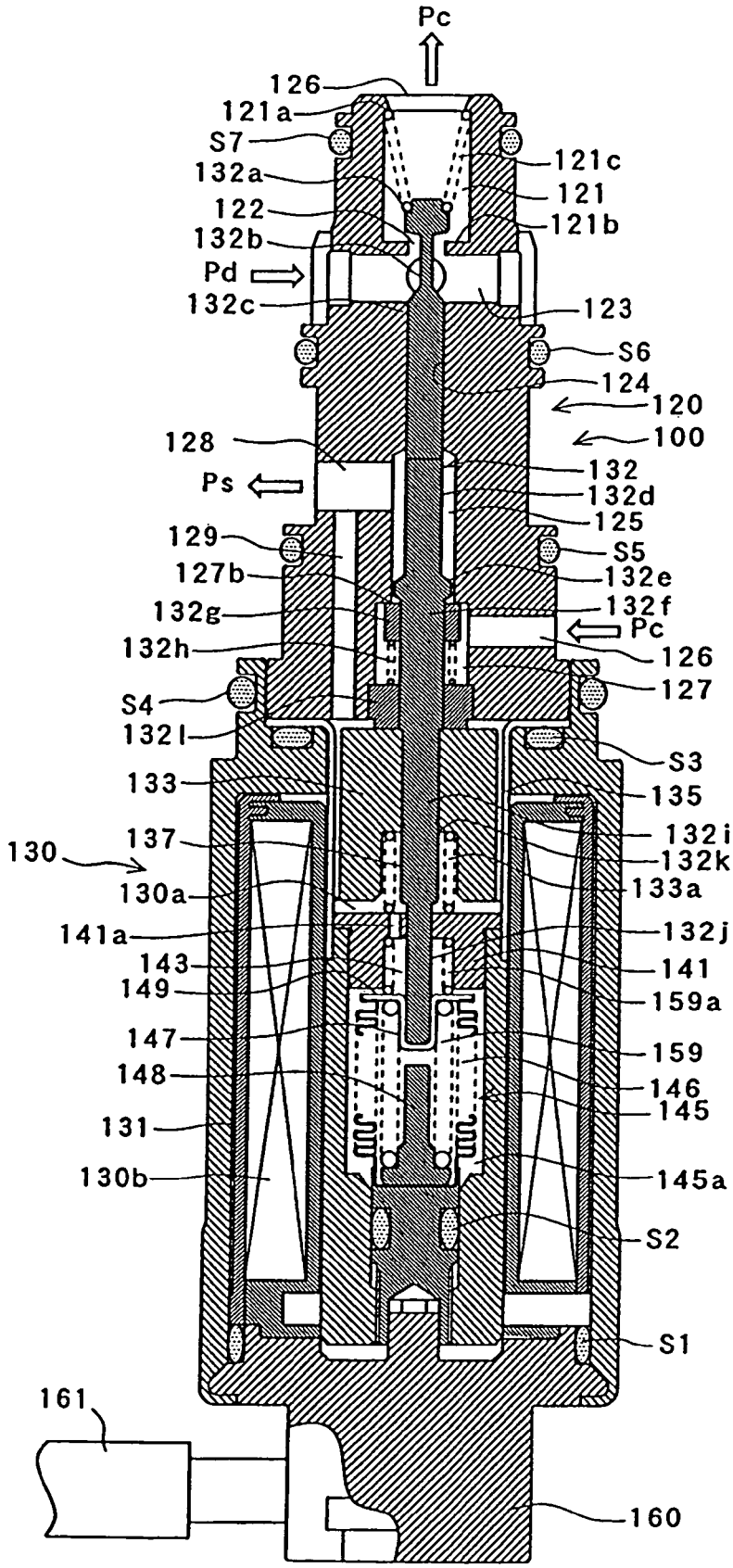
FIG. 1 is an axial cross-sectional view of a control valve according to embodiment 1 employed in a variable capacity compressor.

The control valve 100 shown in FIG. 1 is arranged in a state held in gas-tight fashion by means of O-rings S4, S5, S6, S7 within a control valve space 8 that is formed in the rear housing 6 of the variable capacity compressor 20 shown in FIG. 2.

As shown in FIG. 1, the control valve 100 comprises a control valve main body 120, a solenoid exciting section 130 for performing variable compression capacity control by controlling the coolant pressure Pc within the crank chamber 12, and a pressure-sensitive section 145. The solenoid exciting section 130 is arranged below the control valve 100. The pressure-sensitive section 145 is arranged inside the solenoid exciting section 130. In addition, the control valve main body 120 is arranged at the top of the solenoid exciting section 130.

The solenoid exciting section 130 comprises a solenoid housing 131 that is mounted by means of a solenoid section support tube 135 at the bottom of the control valve main body 120. Within this solenoid housing 131, there are provided a solenoid 130*b*, a plunger 133 that is raised and lowered by excitation of this solenoid 130*b*, and an attraction member 141. A plunger chamber 130*a* in which a plunger 133 is arranged communicates with a suction communication port 128 provided in the control valve main body 120 through a pressure-equalizing hole 129. Also, a lead 161 that supplies exciting current controlled by a control unit (not shown) is connected to the solenoid 130*b* by means of a coil assembly 160.

The plunger 133 is arranged in the interior of the solenoid housing 131 linked with the bottom of the control valve main body 120. This plunger 133 is slidably supported in a solenoid section supporting tube 135 that is joined in a sealing condition by means of an O ring S3 with the end of the control valve main body 120.

A support section 132*i* constituted by the lower part of the valve rod 132 is inserted into an accommodating hole 137 formed in the lower part of the plunger 133. The lower part of the valve rod 132 projects in slidable fashion into a pressure-sensitive chamber 145*a* through a hole formed in the attraction member 141. The bottom end of the support section 132*i* abuts a stop 147 provided at the top of the bellows 146. A plunger spring 133*a* that biases the plunger 133 in a direction away from the attraction member 141 is provided between the plunger 133 and the attraction member 141 (the magnitude of the biasing force of the plunger spring 133*a* will be described later).

Specifically, the valve rod 132 extends downwards so as to abut a flange 149 and the plunger 133 is fixed by caulking (caulking section 132*k*) in this extension (support section 132*i* of the plunger 133). In addition, the lower part of the support section 132*i* is designated as a sliding section 132*j* of the attraction member. Also, a pressure-equalization hole

141*a* connecting the plunger chamber 130*a* and the pressure-sensitive chamber 145*a* is formed in the attraction member 141.

By means of the aforesaid construction, the construction of the valve rod 132 and the plunger 133 is simplified and reliable support of the attraction member sliding section 132*j* by the attraction member 141 can be achieved. Also, the lower part of the sliding section 132*j* of the attraction member is free to approach or separate from an upper stop 147 of the bellows 146 arranged within the pressure-sensitive chamber 145*a*. A spring 159*a* of weak biasing force that biases the stop 147 in a direction such as to separate from the attraction member 141 is provided between the plunger 149, which is integral with this stop 147, and a lower accommodating hole 143 on the side of the attraction member 141. The reference numeral 148 indicates a lower stop 147 of the bellows 146.

The pressure-sensitive unit 145 is arranged in the interior of the solenoid 130*b*. A pressure-sensitive chamber 145*a* is provided in the interior of the pressure-sensitive unit 145. A bellows support spring 159 and the bellows 146 that operates the plunger 133 through the sliding section 132*j* of the attraction member and other items are arranged in this pressure-sensitive chamber 145*a*. The suction coolant pressure Ps is introduced into the pressure-sensitive chamber 145*a* through the pressure-equalizing hole 129 and the plunger chamber 130*a*. In other words, the attraction member sliding section 132*j* and the plunger 133 (i.e. the valve rod 132) are raised and lowered by elongation and contraction of the bellows 146 in accordance with the magnitude of the suction coolant pressure Ps.

As shown in FIG. 1, the control valve main body 120 is a tubular body elongate in the vertical direction and having a plurality of steps creating different diameters. In the interior of this tubular body (hollow core) there are respectively formed in communicating fashion in sequence from top to bottom in the axial direction a crank chamber communicating port 126, a gas supply valve chamber 121, gas supply valve hole 122, delivery communicating port 123, valve rod support section 124, extraction hole 125 communicating with the suction communicating port 128 and extraction valve chamber 127 communicating with the crank chamber communicating port 126.

Also, the valve rod 132 that is elongate in the vertical direction is arranged in the interior of the tubular body of the control valve main body 120. This valve rod 132 comprises a gas supply valve body 132*a* arranged in the gas supply chamber 121, a reduced-diameter section 132*b* that is formed at the position of the delivery communicating port 123 and the gas supply valve hole 122, a support receiving section 132*c*, an extraction hole 132*d* positioned within the extraction valve hole 125, a stop 132*e* mounted on this extraction hole 132*d*, an extraction valve body guide section 132*f*, a support section 132*i* of the plunger 133 and an attraction member sliding section 132*j*. The extraction valve body guide section 132*f* is fitted into and supports a spring receiving section 132*l* that is fixed in gas-tight fashion to the control valve main body 120. The upper part of this spring receiving section 132*l* therefore constitutes the extraction valve chamber 127 and the lower part thereof constitutes the plunger chamber 130*a*, respectively.

Specifically, the gas supply valve body 132*a* is arranged in the interior of the gas supply valve chamber 121 and, as already stated, a crank chamber communicating port 126 is formed in the upper part of the gas supply valve chamber 121 communicating with the crank chamber 12 and low-pressure crank chamber coolant gas is conducted thereto. Also, in the bottom face of the gas supply valve chamber 121, a gas supply valve hole 122 is formed whereby high-pressure coolant gas at the delivery coolant pressure Pd is fed through a delivery conduit passage 10 and a delivery communicating port 123. A gas supply valve seat 121*b* is formed at the periphery of this gas supply valve hole 122. Also, in the gas supply valve chamber 121, between the control valve main body 120 (gas supply spring receiving section 121*a*) and the gas supply valve body 132*a*, a gas supply valve closing spring 121*c* is arranged in compressed fashion.

In addition, low-pressure coolant gas in the crank chamber (coolant pressure Pc) is fed through a crank chamber passage 9*a* and crank chamber communicating port 126 to the extraction valve chamber 127. An extraction valve seat 127*b* is formed at the top face of the extraction valve chamber 127. The coolant gas in the crank chamber flows into a suction conduit passage 9 from the suction communicating port 128 through the extraction valve chamber 127, extraction valve seat 127*b* and extraction valve hole 125.

An extraction valve body 132*g* is arranged in this extraction valve chamber 127. This extraction valve body 132*g* is a tubular body and is capable of sliding in the vertical direction guided by an extraction valve body guide section 132*f* that passes through the internal space of this tubular body. Also, an extraction valve closing spring 132*h* is mounted between the bottom face of this extraction valve body 132*g* and an upper face section of the spring receiving section 132*l*, biasing the extraction valve body 132*g* upwards.

The upper face (face abutting the extraction valve seat 127*b*) of the extraction valve body 132*g* is a face that is perpendicular to the axis of the valve rod 132. Also, the extraction valve seat 127*b* is a face that is perpendicular to the axis of the valve rod 132. The upper face of the extraction valve body 132*g* and the lower face of the extraction valve seat 127*b* therefore constitute parallel faces facing each other, this upper face and lower face being capable of abutment (valve closure) and separation (valve opening). It should be noted that the upper face of the extraction valve body 132*g* could be an inclined face instead of being perpendicular to the axis of the valve rod 132 and the extraction valve seat 127*b* could also be an inclined face instead of being perpendicular to the axis of the valve rod 132. One face may be perpendicular with respect to the axis while the other may be inclined with respect to the axis.

As a result, in the opening/closure action of the extraction valve body 132*g*, expansion/contraction of the flow path area can be achieved at a stroke, so that the action of controlling the variable capacity compressor that accompanies this opening/closure of the extraction valve body 132*g* is achieved in a rapid fashion.

Also, as described above, in a portion of the valve rod 132 corresponding to the extraction valve hole 125, a stop 132*e* of larger diameter than the diameter of the extraction valve body guide section 132*f* is formed so that the extraction valve body 132*g* is biased by this stop 132*e*.

It should be noted that, although, in this embodiment, the stop 132*e* is integral with the valve rod 132, if this stop 132*e* is formed so as to be capable of vertical positional adjustment with respect to the valve rod 132, the timing of opening/closure of the extraction valve body 132*g* with respect to the gas supply valve body 132*a* could be adjusted. Also, the valve rod 132 could be divided at a suitable location, for example, at the region of the boundary between the support receiving section 132*c* and extraction hole 132*d*.

Also, by altering the position of the stop 132*e* with respect to the valve rod 132 in embodiment 1, it is possible to alter the valve opening timing of the extraction valve body 132*g* with respect to the gas supply valve body 132*a* without altering the fully-open lift of the gas supply valve body 132*a*. Also, by providing a notch in the upper face of the extraction valve body 132*g* (face facing the extraction valve seat 127*b*), a construction can be produced in which a minimum flow path area can be ensured when the extraction valve body 132*g* is in the fully open position. Instead of the upper face of the extraction valve body 132*g*, the notch could be provided in the lower face of the extraction valve seat 127*b* (face facing the extraction valve body 132*g*); however, provision in the upper face of the extraction valve body 132*g* is easier in regard to processing.

Next, the action of the control valve 100 will be described in conjunction with the action of the variable capacity compressor 20. In the operating condition of the variable capacity compressor 20, in the state in which supply of current to the solenoid exciting section 130 is OFF, as shown in FIG. 1, the gas supply valve body 132*a* is in the "fully open" condition and the extraction valve body 132*g* is in the "fully closed" condition. In this condition, control of coolant pressure of the discharge coolant pressure Pd and the crank chamber coolant pressure Pc accompanying fluctuation of the suction coolant pressure Ps is therefore not effected.

When current is passed to the solenoid exciting section 130 through the lead 161 causing control to be commenced, the valve rod 132 is lowered by a prescribed distance in accordance with the amount of current supplied, shifting the gas supply valve body 132*a* from the "fully open" condition into the "open" condition and shifting the extraction valve body 132*g* from the "fully closed" condition into the "open" condition or leaving it in the "fully closed" condition.

Then, in a state in which the electromagnetic force of the solenoid exciting section 130 is fixed (controlled condition), with the current value being fixed, the degree of opening of the gas supply valve body 132*a* is adjusted, accompanying fluctuation of the suction coolant pressure Ps. Concurrently, adjustment (opening/closure) of the degree of opening of the extraction valve body 132*g* in an amount corresponding to the amount of adjustment of the degree of opening of the gas supply valve body 132*a* is also effected, through the valve body 132. Meanwhile, when the suction coolant pressure Ps rises, the stop 147 is lowered and the gas supply valve body 132*a* is shifted in the "closure" direction and the extraction valve body 132*g* is also concurrently shifted in the "opening" direction, through the valve rod 132, so that, by a co-operative action of the gas supply valve body 132*a* and the extraction valve body 132*g*, rapid lowering of the crank chamber coolant pressure Pc is performed.

Also, contrariwise, meanwhile, when the suction coolant pressure Ps drops, the stop 147 is raised and the gas supply valve body 132*a* is shifted in the "opening" direction, while the extraction valve body 132*g* is also shifted in the "closure" direction through the valve rod 132, so that, by co-operative action of the gas supply valve body 132*a* and the extraction valve body 132*g*, rapid raising of the crank chamber coolant pressure Pc is achieved.

Thus, when the electromagnetic force of the control valve 100 is changed by changing the value of the current supplied to the solenoid 130*b*, in response to this, the crank chamber coolant pressure Pc changes, thereby producing an alteration of the compression capacity (delivery rate), resulting in a state in which the suction coolant pressure Ps is maintained fixed at a different level.

Specifically, when the electromagnetic force of the control valve 100 becomes small, the plunger 133 is raised by a prescribed amount by the spring force of the plunger spring 133*a* and reaction of the bellows 146. Accompanying this, the valve rod 132 is raised, and the gas supply valve body 132*a* is raised (the amount of its aperture is increased). As a result, the rate of flow of coolant from the delivery communicating port 123 to the gas supply valve chamber 121 is increased. Also, by raising of the extraction valve body 132*g* (decrease of the amount of its aperture), the flow rate of coolant from the crank chamber communicating port 126 to the suction communicating port 128 is decreased. Thus, by co-operative action of the gas supply valve body 132*a* and the extraction valve body 132*g*, the crank chamber coolant pressure Pc rapidly rises and the rocking plate 14 assumes an attitude that is close to perpendicular with respect to the rotary shaft 11, with the result that the delivery rate of coolant is rapidly decreased.

Contrariwise, when the electromagnetic force of the control valve 100 is increased, the plunger 133 is lowered by a prescribed amount by the attractive force of the attraction member 141, so that the valve rod 132 is lowered and the gas supply valve body 132*a* is lowered (the amount of its aperture is decreased). As a result, the coolant flow rate from the delivery communicating port 123 to the gas supply valve chamber 121 is decreased. Also, by lowering of the extraction valve body 132*g* (or by increasing the amount of its aperture), the coolant flow rate from the crank chamber communicating port 126 to the suction communicating port 128 is increased. Thus, by co-operative action of the gas supply valve body 132*a* and the extraction valve body 132*g*, the crank chamber coolant pressure Pc is rapidly lowered and the angle of inclination of the rocking plate 14 with respect to the rotary shaft 11 is decreased, rapidly increasing the delivery rate of coolant.

Control of the value of the current that is passed to the solenoid 130*b* is performed by inputting, to a control unit incorporating a CPU and other items, detection signals from temperature sensors inside and outside the engine and the vehicle compartment, an evaporator sensor and a plurality of sensors that detect various other conditions and then delivering signals based on the results of computational processing thereof to the solenoid 130*b* from the control unit control. The drive circuit of the solenoid 130*b* is not shown.

In a state in which supply of current to the solenoid 130*b* is stopped, the difference in the biasing force of the gas supply valve closing spring 121*c* that biases the valve rod 132 of the control valve 100 and the plunger spring 133*a* separates the gas supply valve body 132*a* from the gas supply valve seat 121*b*, putting the gas supply valve in a fully open condition.

When this happens, the crank chamber coolant pressure Pc rises, trying to put the rocking plate 14 in an attitude that is close to perpendicular with respect to the rotary shaft 11. However, since a notch is provided on the upper surface of the extraction valve body 132*g*, when the extraction valve body 132*g* is in the fully closed position, a minimum flow path area can be ensured before the rocking plate 14 assumes an attitude perpendicular to the rotary shaft 11. Minimum flow rate operation of the variable capacity compressor 20 can therefore be maintained by balance of the amount of inclination of the rocking plate 14 with the resilient force of the minimum flow rate maintaining spring 19.

In this way, when current supply to the solenoid 130*b* of the solenoid exciting section 130 is stopped, the variable capacity compressor 20 assumes a minimum flow rate operating condition, so that, even when operation of the variable capacity compressor 20 is not required, the rotary shaft 11 can be left in a state where it is being driven. The present invention can therefore also be applied to a clutch-less variable capacity compressor 20.

Thus, although the biasing force of the gas supply valve closing spring 121*c* is made to be smaller than the biasing force of the plunger spring 133*a* in order to put the gas supply valve body 132*a* into the "open" condition when control is OFF, these biasing forces may be set in the design process such that the aforesaid function is realized.

By sensing the suction coolant pressure Ps of the variable capacity compressor, the control valve of embodiment 1 operates the two valve bodies so as to adjust the crank chamber coolant pressure Pc (on the gas supply side) by allowing coolant from the delivery conduit (delivery coolant pressure Pd) to flow into the crank chamber (crank chamber coolant pressure Pc) and so as to adjust the crank chamber coolant pressure Pc by allowing the coolant in the crank chamber to outflow to the suction conduit (suction coolant pressure Ps). By means of these two adjustments, the response of regulatory control of the crank chamber coolant pressure Pc is improved, making it possible to decrease wasted flow of coolant from the delivery conduit to the crank chamber and thereby to improve control efficiency.

In this embodiment 1, the inconvenience may arise that vibration of the extraction valve body 132 is generated in a state in which the coolant in the crank chamber is being allowed to flow out into the suction conduit, due to the pressure difference (Pc-Ps) between the crank chamber coolant pressure Pc and the suction coolant pressure Ps acting on the extraction valve body 132*g*. Accordingly, in order to prevent such vibration (hunting) of the extraction valve body 132*g*, the following technique is applied.

Figure 4:
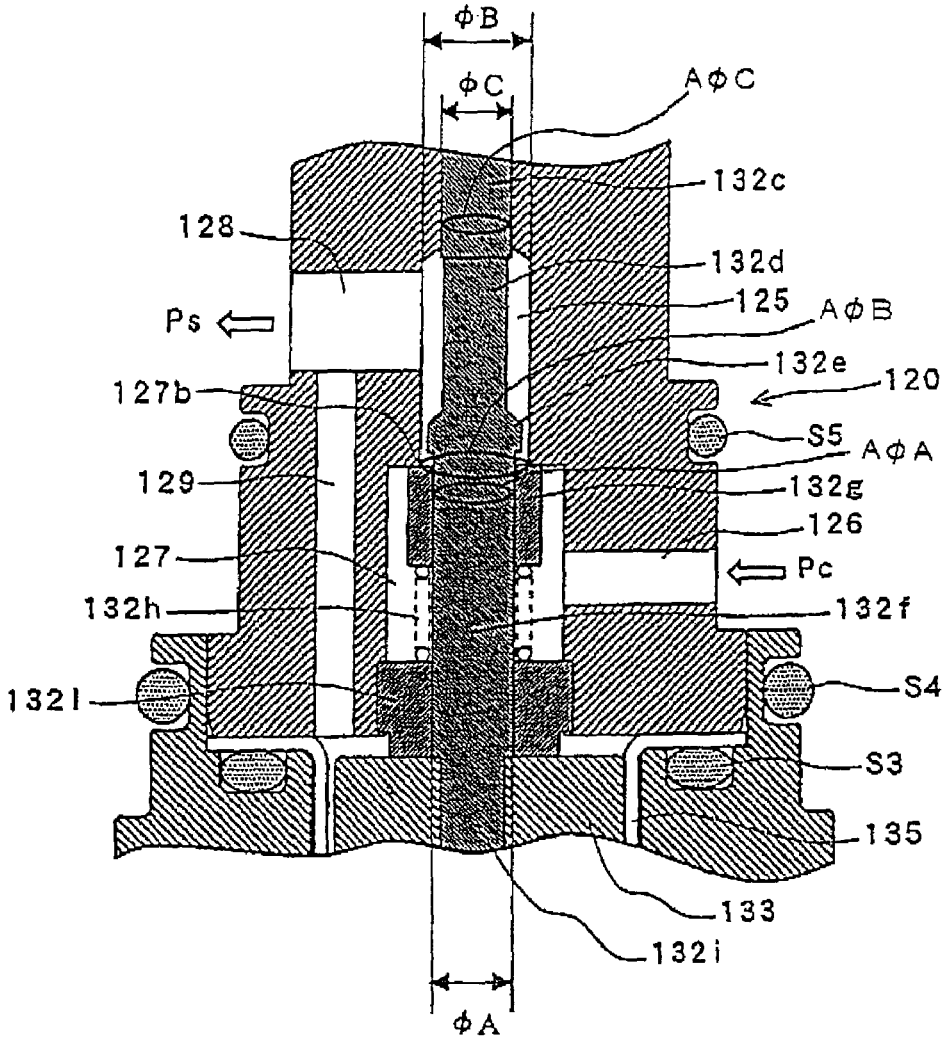
FIG. 4 is a detail cross-sectional view given in explanation of the action of the control valve of FIG. 1.

Specifically, as shown in FIG. 4, when the actions of the coolant pressure on the valve rod 132 and the extraction valve body 132*g* are considered, it is found that, in regard to the valve body 132, a force of Pc·AϕC acts downwards from above and a force Ps·AϕC acts upwards from below, so that, overall, a force (Pc-Ps)·AϕC acts on the valve rod 132. Here, AϕC is the cross-sectional area of diameter ϕC mm (external diameter of the gas supply valve support receiving section 132*c*).

Also, in regard to the extraction valve body 132*g*, a force Ps·(AϕB−AϕA) acts downwards from above and a force of Pc·(AϕB−AϕA) acts upwards from below, so that, overall, a force of (Pc-Ps)·(AϕB−AϕA) acts on the extraction valve body 132*g*. Here, AϕA is the cross-sectional area of diameter ϕA mm (cross-sectional area of the extraction valve body 132*a*) and AϕB is the cross-sectional area of diameter ϕB mm (diameter of the extraction valve hole 125).

From the knowledge that the vibration of the extraction valve body 132*g* is caused by the difference between the force of the coolant acting on the extraction valve body 132*g* and the force of the coolant acting on the valve rod 132, the vibration of the extraction valve body 132*g* can be eliminated by making the difference of these forces zero. In other words, $$(Pc\text{-}Ps)\cdot A\phi C-(Pc\text{-}Ps)\cdot(A\phi B-A\phi A)=0$$

From this, AϕA=AϕB−AϕC can be derived.

Accordingly, ϕB (diameter of the extraction valve hole 125), ϕA (cross-sectional area of the extraction valve body 132 A) and ϕC (external diameter of the gas supply valve support receiving section 132*c*) should be determined so as to satisfy AϕA=AϕB−AϕC. In embodiment 1, vibration of the extraction valve body 132*g* and valve rod 132 can be suppressed by selection of these dimensions. Also, in embodiment 1, the extraction valve body 132*g* is on the side of the crank chamber coolant pressure Pc, so that the coolant pressure can act on the extraction valve body 132*g* and prevention of vibration can be performed smoothly.

Embodiment 2

Figure 5:
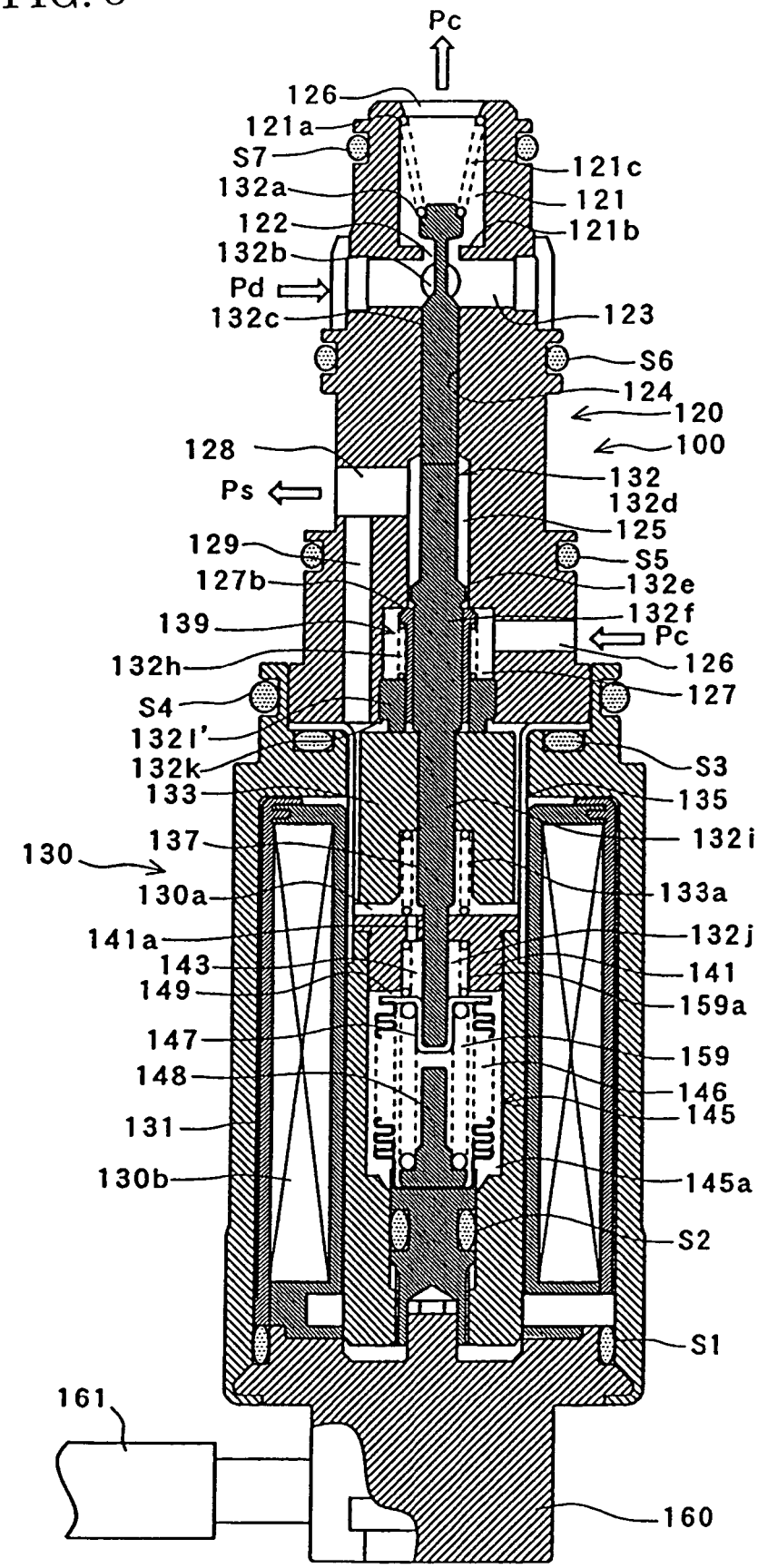
FIG. 5 is an axial cross-sectional view of a control valve according to embodiment 2.

Next, embodiment 2 of the present invention is described with reference to FIG. 5 and FIG. 6. This embodiment is an improvement of embodiment 1 (FIG. 1). In the description of this embodiment, components that are common to embodiment 1 are given the same reference numerals in FIG. 5 and FIG. 6 as the symbols used in FIG. 1 and FIG. 2 and further description thereof is omitted here.

In embodiment 2, in order to reduce as far as possible the difference of the coolant pressures acting on the extraction valve body 139, it is arranged that the coolant pressures from above and below the extraction valve body 139 should be cancelled.

Figure 6:
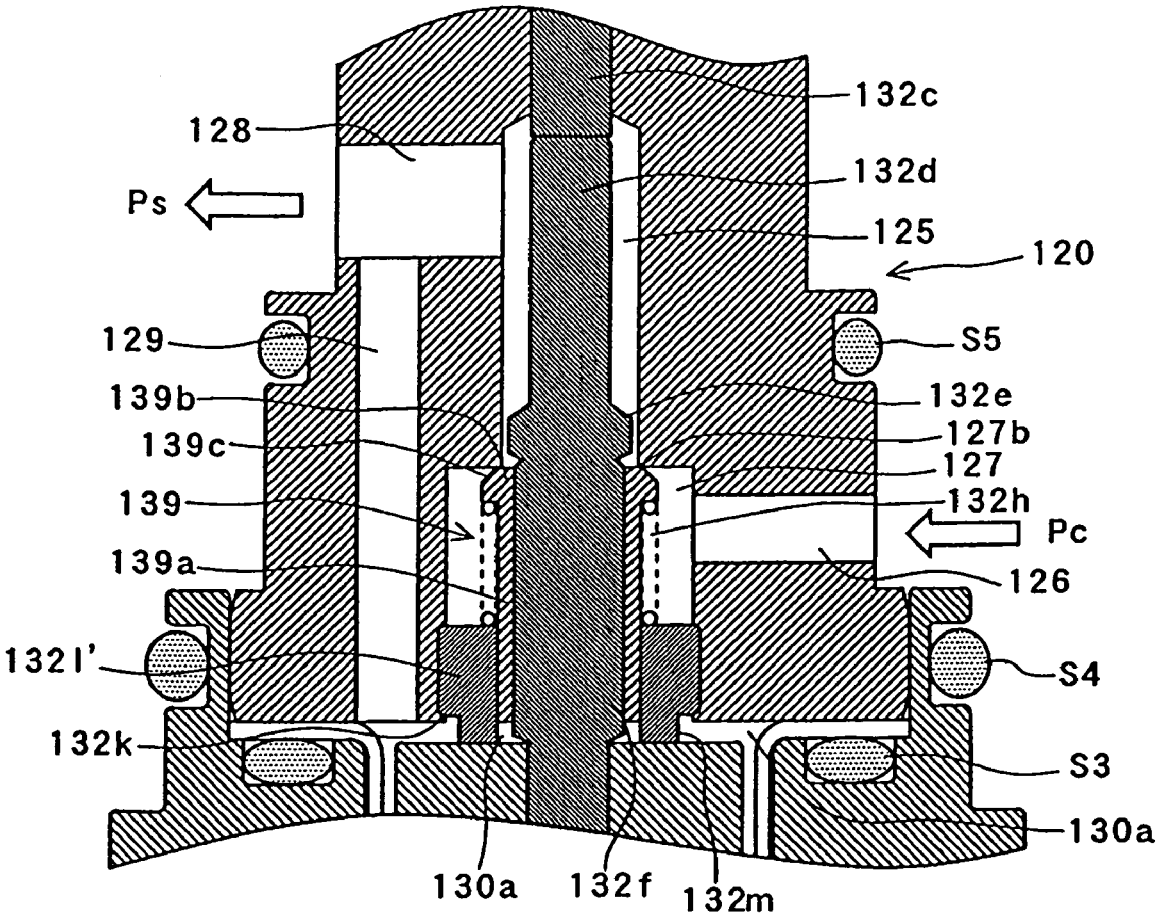
FIG. 6 is a detail cross-sectional view given in explanation of the action of the control valve of FIG. 5.

As shown in particular in FIG. 6, the extraction valve body 139 therefore comprises a tubular section 139*a* which extends in the vertical direction and is externally fitted onto an extraction valve body guide section 132*f*, a larger-diameter section 139*b* formed at the upper end of this tubular section 139*a*, and an inclined section 139*c* formed at the outer circumference of the upper face of this larger diameter section 139*b*. Also, the lower part of the tubular section 139*a* is freely slidably fitted between the inner circumferential surface of a spring receiving section 132*l'* and the outer circumferential surface of the extraction valve guide section 132*f*, while the bottom end thereof is constructed facing the plunger chamber 130*a*, so as to receive the action of the suction coolant pressure Ps. Also, an extraction valve closing spring 132*h* is mounted in compressed fashion between the larger-diameter section 139*b* and the spring receiving section 132*l'*. The lower part of the spring receiving section 132*l'* constitutes a small diameter section 132*m*, the control valve main body 120 being engaged with the shoulder of this small diameter section 132*m*.

In the above construction, suction coolant pressure Ps from the extraction valve hole 125 acts on the upper face of the extraction valve body 139 (upper face of the larger diameter section 139*b*). Also, suction coolant pressure Ps acts on the lower part of this extraction valve body 139 through the pressure-equalizing hole 129 for the suction coolant pressure Ps, too. That is, the suction coolant pressure Ps is cancelled by the action of the suction coolant pressure Ps from above and below the extraction valve body 139.

Also, since the upper portion (inclined section 139*c*) and the lower portion (spring receiving section) of the extraction valve body larger-diameter section 139*b* are within the extraction valve chamber 127, the crank chamber coolant pressure Pc acts thereon from above and below, so that the crank chamber coolant pressure Pc is cancelled. In addition, flow of coolant can easily take place at the inclined section 139*c* at the top of the extraction valve body larger-diameter section 139*b*, so that there is little effect of dynamic pressure acting on the extraction valve body 132*a*. Also, with the inclined section 139*c*, the contact area of the extraction valve body 132*a* and the extraction valve seat 127*b* is small, so that the effect is obtained that, foreign bodies or the like are unlikely to stick thereon.

In embodiment 2, with the construction described above, the shapes are such that the coolant pressure acting on the suction valve body and the extraction valve body is cancelled or the coolant pressure hardly acts on the valve bodies, so that generation of vibration of the extraction valve body is suppressed and precise control using the solenoid exciting section 130 can be achieved.

Embodiment 3

Figure 7:
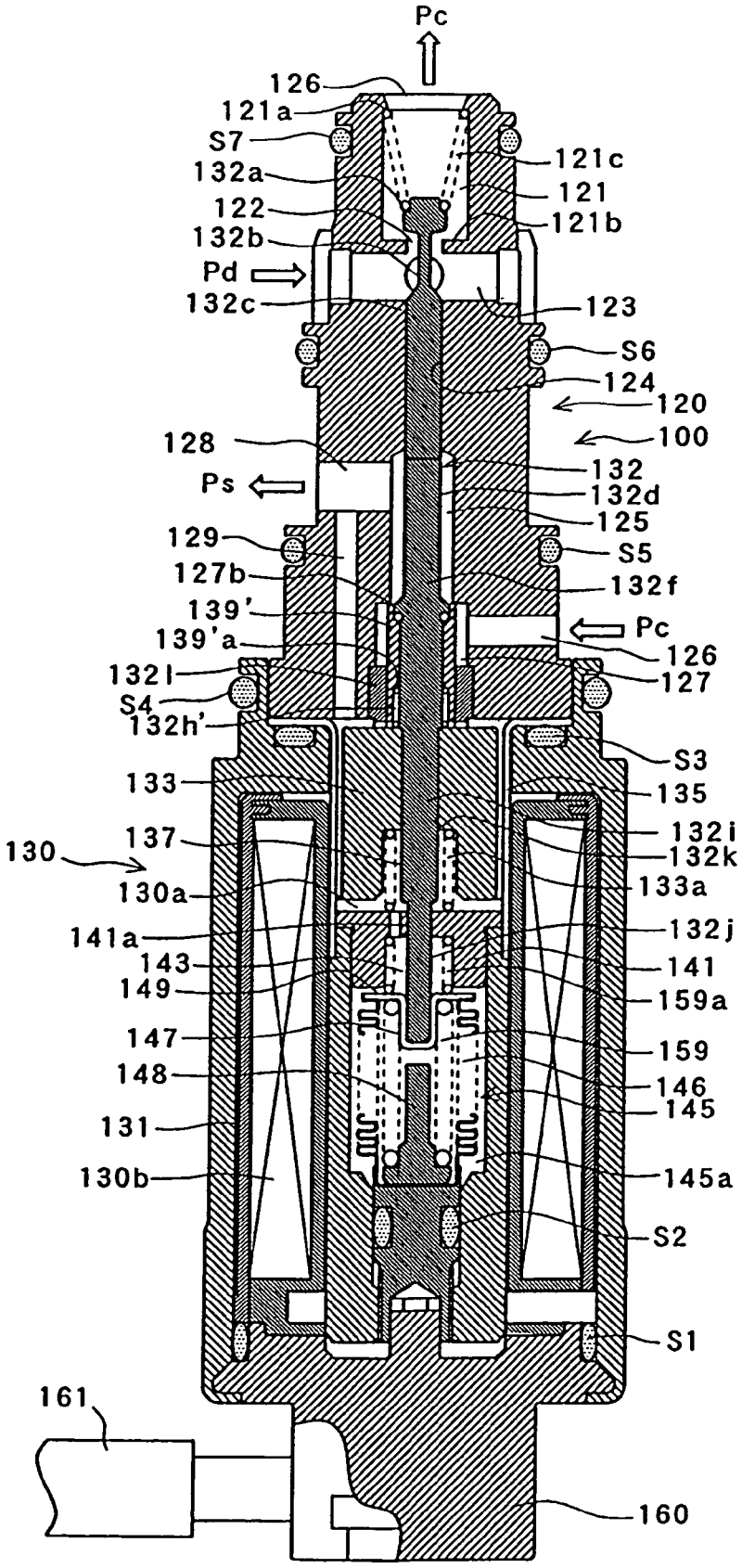
FIG. 7 is an axial cross-sectional view of a control valve according to embodiment 3.

Next, embodiment 3 of the present invention will be described with reference to FIG. 7. Embodiment 3 is a modified example of embodiment 1. In the description of this embodiment, components that are common to embodiment 2 are given the same reference numerals in FIG. 7 as those used in FIG. 5 and FIG. 6 and further description thereof is omitted here.

In this embodiment, the flow resistance of the fluid is further reduced by accommodating the stop 132*e* in the interior of the extraction valve body 139' (at the position of the extraction valve chamber 127). Also, although in embodiment 2 the extraction valve closing spring 132*h* is mounted in compressed fashion between the lower part of the larger diameter section 139*b* of the extraction valve body 139 and the upper face of the spring receiving section 132*l'*, in embodiment 3 the extraction valve closing spring 132*h'* is mounted in compressed fashion between the notched lower face 139'*a* of a cylindrical extraction valve body 139' and the upper face of the plunger 133.

With this construction, in embodiment 3, no larger-diameter section 139*b* is provided on the extraction valve body 139' so that, compared with embodiment 2, the flow of coolant at the extraction valve body 139' is smoother, making it possible to reduce coolant flow losses and, in addition, making it possible to further reduce generation of noise accompanying the flow of coolant.

Embodiment 4

Next, embodiment 4 of the present invention will be described with reference to FIG. 8 to FIG. 9C. In the description of this embodiment, components that are common to embodiments 1 to 3 are given the same reference numerals in FIG. 8 to FIG. 9C as those used in FIG. 1 to FIG. 7 and further description thereof is omitted here.

Thus, whereas in embodiments 1 to 3, a pressure-equalizing hole 129 was formed by drilling processing of the control valve main body 120, in embodiment 4, instead of this, a slit-shaped groove is provided in the extraction valve 139", thereby simplifying the processing of the control valve body 120 and saving processing time.

Figure 8:
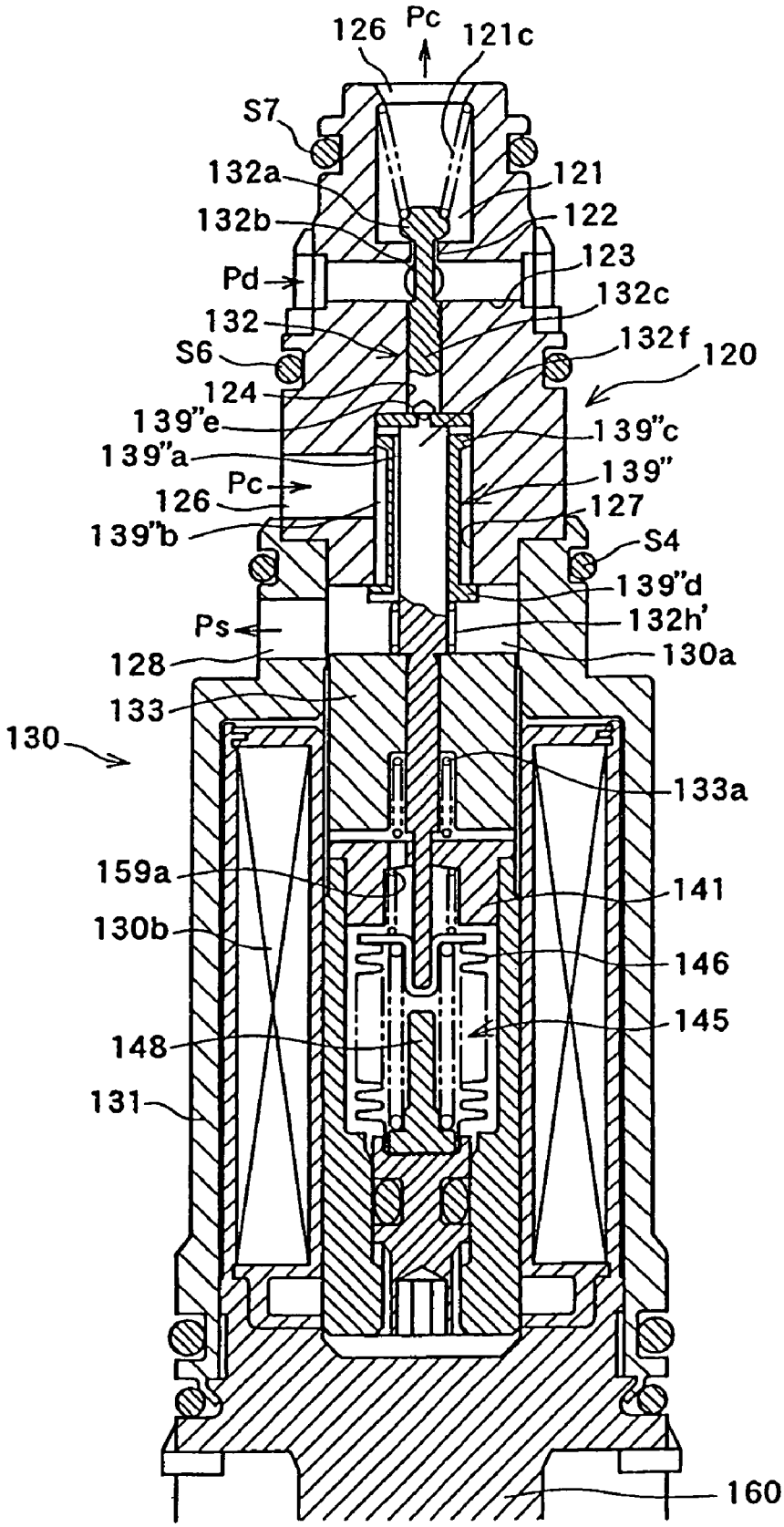
FIG. 8 is an axial cross-sectional view of the control valve according to embodiment 4.
Figure 9A:
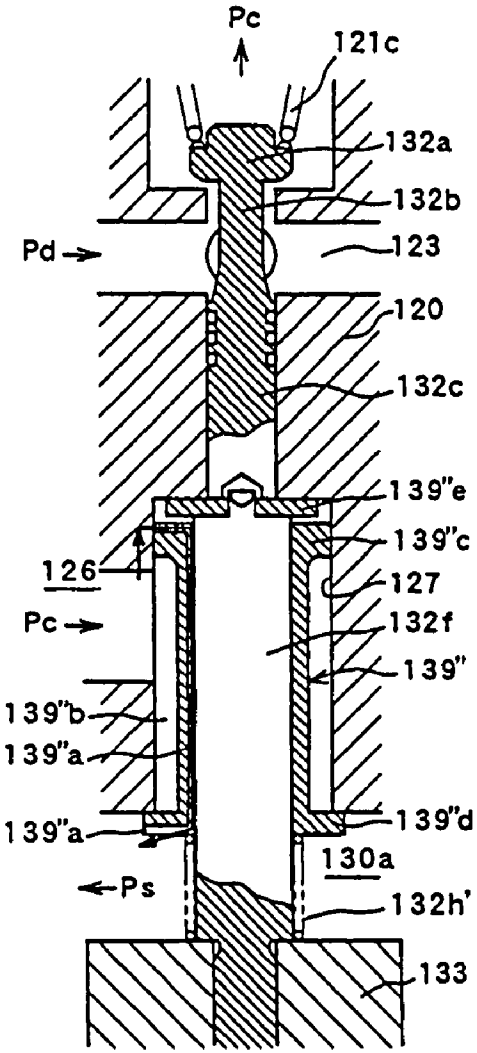
FIG. 9A to FIG. 9C are diagrams of the action of the control valve of FIG. 8.

As shown in FIG. 2, FIG. 8 and FIG. 9A, in the control valve of this embodiment, coolant that is sucked in from a suction chamber 3 through a suction conduit 1 is compressed and is delivered into a delivery chamber 4 through a delivery conduit 2 and coolant pressure control is performed by means of a control valve 100 provided with a solenoid exciting section 130 including a plunger 133.

The control valve 100 comprises a control valve main body 120, a solenoid exciting section 130 for controlling the coolant pressure within the crank chamber 12 and a pressure-sensitive section 145. The solenoid exciting section 130 is arranged at a position below the control valve 100. The pressure-sensitive section 145 is arranged inside the solenoid exciting section 130 and, in addition, the control valve main body 120 is arranged at the top of the solenoid exciting section 130. An extraction valve body 139", arranged between the suction conduit 1 and the crank chamber 12, and an air supply valve body 132*a*, arranged between the crank chamber 12 and the delivery conduit 2, are subjected to opening/closure control in accordance with the balance of the attractive force of the solenoid exciting section 130, the reaction of the bellows 146 and the suction coolant pressure.

The control valve main body 120 is a tubular body that extends in the vertical direction. In the interior of this tubular body there are respectively formed in sequence from top to bottom along the axis a gas supply valve chamber 121 communicating with a crank chamber communicating port 126, gas supply valve hole 122, delivery communicating port 123, valve rod support section 124 and extraction valve chamber 127 communicating with the crank chamber communicating port 126. These communicate with a plunger chamber 130*a* that communicates with a suction communication port 128 formed on the side of the solenoid housing 131.

Also, the valve rod 132 that is elongate in the vertical direction is arranged in the interior of the tubular body of the control valve main body 120. This valve rod 132 comprises an integrated unit comprising a gas supply valve body 132*a*, a reduced-diameter section 132*b* and a support receiving section 132*c*; and an extraction valve body guide section 132*f* separate from this integrated unit. The gas supply valve body 132*a* is arranged in the interior of the gas supply valve chamber 121. The reduced-diameter section 132*b* is arranged at the gas supply valve hole 122 and delivery communicating port 123. The support receiving section 132*c* is supported by a valve rod support section 124. The extraction valve body guide section 132*f* is positioned within the extraction valve chamber 127 and is integral with a plunger 133.

The bottom end of the support receiving section 132*c* and the top end of the extraction valve body guide section 132*f* are oppositely arranged, with an extraction valve plate 139"*e* interposed therebetween. This extraction valve plate 139"*e* is in the form of a ring plate and fixed to the top end face of the extraction valve body guide section 132*f*. The extraction valve body 139 is slidably fitted onto the extraction valve body guide section 132*f* and is biased upwards (towards the support receiving section 132*c*) and is located in position by means of the extraction valve plate 139"*e*.

Also, an inner groove 139"*a* and an outer groove 139"*b* that provide communication from a crank chamber communicating port 126 to a suction communicating port 128 are formed in the axial direction thereof on the extraction valve body 139. The rate of flow of coolant through the inner groove 139"*a* and the outer groove 139"*b* is controlled in accordance with the position in the vertical direction of the extraction valve body 139 with respect to the extraction valve body guide section 132*f*. The extraction valve body 139 is formed in the form of a pipe, the inner groove 139"*a* being formed on the inside face of the pipe and the outer groove 139"*b* being formed as an outer groove on the outer face of the pipe, respectively.

Respective flange-shaped flats 139"*c* and 139"*d* are formed on the upper and lower edges of the extraction valve body 139. In addition, the outer circumferential end of the upper flat 139"*c* that is formed at the top edge is in sliding contact with the side face of the extraction valve chamber 127 and the upper face of the lower flat 139"*d* that is formed at the bottom edge is constituted so as to abut the upper face of the plunger chamber 130*a* when the extraction valve is moved upwards. Also, the extraction valve body 139" is biased upwards (towards the support receiving section 132*c*) with respect to the plunger 133 by means of an extraction valve closing spring 132*h'*.

In other words, a crank chamber communicating port 126 whereby crank chamber coolant (Pc) flows in is formed at the side of the delivery communicating port 123 (upper side) where the delivery coolant (Pd) flows in and a suction communicating port 128 is formed at the side of the plunger 133 (lower side) therebelow. Also, the valve rod 132 is divided into an upper portion and lower portion, the upper portion constituting the gas supply valve body 132*a*, the reduced-diameter section 132*b* and support receiving section 132*c* and the lower portion constituting the extraction valve body guide section 132*f* that is fixed to the plunger 133.

A pipe-shaped extraction valve body 139" is slidably fitted onto this extraction valve body guide section 132*f*. Flange-shaped flats (upper flat 139"*c* and lower flat 139"*d*) are formed at both ends of this extraction valve body 139" and slit-shaped grooves (inner groove 139"*a* and outer groove 139"*b*) are formed in the axial direction at the circumference of the inner and outer faces of the extraction valve body 139" including the upper flat 139"*c* and the lower flat 139"*d*.

With this construction, as shown in FIG. 9A, in a state (hereinafter referred to as first state) in which current is not supplied to the solenoid exciting section 130, the support receiving section 132*c* provided on the valve rod 132 is in the upper position and the gas supply valve body 132*a* is in the "open" condition. Also, when the extraction valve body guide section 132*f* is in the upper position, the extraction valve plate 139"*e* has no effect, so (the extraction valve plate 139"*e* abuts the upper bottom section of the extraction valve chamber 127) the extraction valve body 139" is therefore also in the upper position.

In this state, the upper flat 139"*c* of the extraction valve body 139" abuts the inside wall of the extraction valve chamber of 127 and the upper face of the lower flat 139"*d* is pressed against the upper face of the plunger chamber 130*a* by the resilient force of the extraction valve closing spring 132*h*'. Accordingly, the coolant (Pc) in the crank chamber communicating port 126 passes through the flow path formed between the upper flat 139"*c* and the inside wall of the extraction valve chamber 127 and the inner groove 139"*a* of the extraction valve body 139, as shown by the arrow, and reaches the suction communicating port 128 (Ps). In other words, in the first state, a "closed" condition is produced between the crank chamber communicating port 126 and the suction communicating port 128, albeit a slight flow of coolant takes place.

Figure 9B:
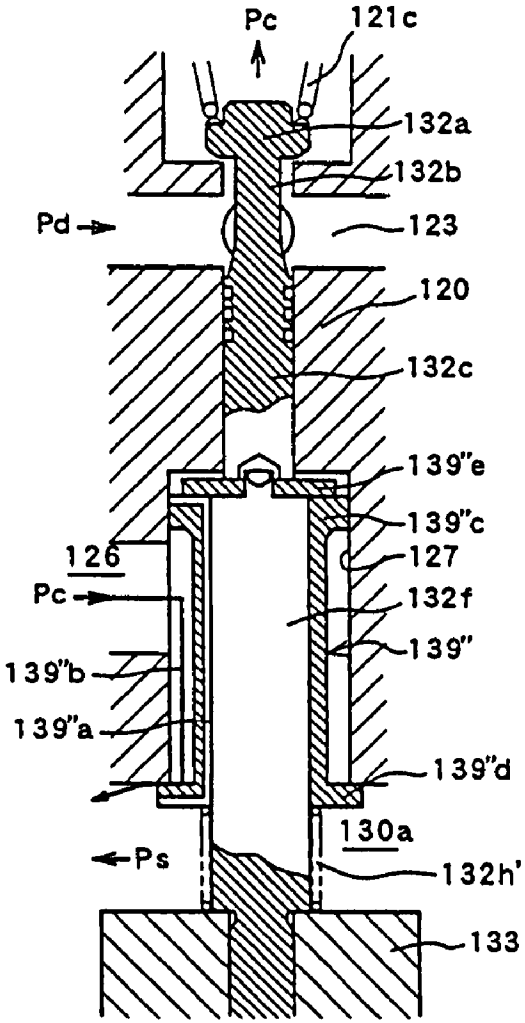

In contrast, in a state (hereinafter referred to as second state) in which, as shown in FIG. 9B, no more than a prescribed small amount of current flows in the solenoid exciting section 130, the support receiving section 132*c* provided on the valve rod 132 is lowered, with the result that the gas supply valve body 132*a* stays in the "open" condition. Further, with further lowering (slight lowering from the first state) of the plunger 133, the extraction valve body guide section 132*f* is also lowered. As a result, the extraction valve plate 139"*e* is lowered, and the extraction valve body 139" is also pressed downwards, causing it to be lowered slightly.

In this state, the upper flat 139"*c* of the extraction valve 139" abuts the inside wall of the extraction valve chamber 127 and a slight flow path is formed between the lower flat 139"*d* and the inside wall of the extraction valve chamber 127. The coolant (Pc) in the crank chamber communicating port 126 therefore passes through the outer groove 139"*b* of the extraction valve body 139 as shown by the arrow and arrives at the suction communicating port 128 (Ps). In other words, in the second state, an "open" condition is produced between the crank chamber communicating port 126 and the suction communicating port 128 (however, this is not a "fully open" condition as in the third state, to be described later).

Figure 9C:
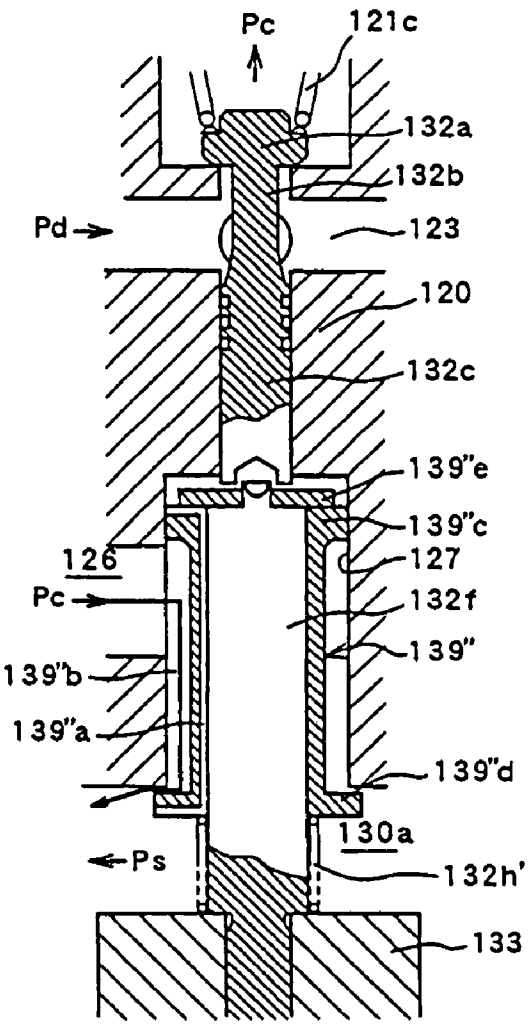

Next, as shown in FIG. 9C, in a state (hereinafter referred to as third state) in which a prescribed amount of current is supplied in the solenoid exciting section 130, the support receiving section 132*c* provided on the valve rod 132 is lowered, causing the gas supply valve body 132*a* to assume a "closed" condition. In addition, the extraction valve body guide section 132*f* is further lowered, accompanying the further lowering of the plunger 133. As a result, the extraction valve plate 139"*e* is lowered and the extraction valve body 139" is also pressed downward and lowered.

As a result, in a state in which the upper flat 139"*c* of the extraction valve body 139" abuts the inside wall of the extraction valve chamber 127, a flow path is formed between the lower flat 139"*d* and the inside wall of the extraction valve chamber 127, so that coolant (Pc) from the crank chamber communicating port 126 passes through the outer groove 139"*b* of the extraction valve body 139" as shown by the arrow, reaching the suction communicating port 128 (Ps). In other words, in the "closed" condition of the gas supply valve body 132*a*, a fully open condition is produced between the crank chamber communicating port 126 and the suction communicating port 128.

As described above, the basic action of the inner groove 139"*a* and the outer groove 139"*b* of the extraction valve body 139 in embodiment 4 is the same as that of the pressure-equalizing hole in the other embodiments, but may be said to differ in that flow rate control is performed. This embodiment 4 is ideal for an extraction valve body 139" made of plastics in that the component is easy to manufacture and offers advantages in terms of space. Also, in this embodiment 4, the suction communicating port 128 (Ps) can be arranged in the vicinity of the solenoid exciting section 130, so that it accords with the requirements in respect of the overall construction of the compressor (to reduce the effect of heat on the solenoid exciting section 130).

What is claimed is:

1. A control valve for a variable capacity compressor, wherein coolant pressure control is performed by means of the control valve that comprises a solenoid exciting section including a plunger and coolant that is sucked in from a suction chamber through a suction conduit is compressed and delivered into a delivery chamber through a delivery conduit;

said control valve comprises a control valve main body, the solenoid exciting section for controlling the coolant pressure within the crank chamber and a pressure-sensitive section, said solenoid exciting section is arranged in a position at the bottom of the control valve, said pressure-sensitive section is arranged inside the solenoid exciting section and, in addition, said control valve main body is arranged at the top of the solenoid exciting section;

opening/closing control of a gas supply valve body arranged in a first fluid communication path between said delivery conduit and said crank chamber and of an extraction valve body arranged in a second fluid communication path between the crank chamber and the suction conduit is performed in accordance with the balance of the attractive force of said solenoid exciting section, the reaction of a bellows and the suction coolant pressure;

said control valve main body is a tubular body extending in the vertical direction and is formed with a gas supply valve chamber that communicates with a crank chamber communicating port, a gas supply valve hole, a delivery communication port, a valve rod support section, an extraction valve chamber communicating with the crank chamber communicating port, and a plunger chamber communicating with a suction communicating port, along an axis, within the tubular body thereof;

a valve rod that is elongate in the vertical direction is arranged in the internal space of said tubular body, and the valve rod comprises a unitary body comprising the gas supply valve body arranged in the gas supply valve chamber, a reduced-diameter section formed at said gas supply valve hole and the delivery communication port and a support receiving section that is supported at said valve rod support section, and an extraction valve body guide section that is connected to said plunger and positioned within said extraction valve chamber;

said extraction valve body is slidably fitted into said extraction valve body guide section and arranged biased towards said unitary body side and is located in position by means of an extraction valve plate; and said extraction valve body is formed with at least one groove that allows fluid communication between the suction communication port and the crank chamber communication port and the rate of flow of coolant through said at least one groove is controlled by the vertical position of said extraction valve body with respect to said extraction valve body guide section, wherein the extraction valve body is formed in pipe shape and said at least one groove is formed as an internal groove in the inner surface of said pipe and an external groove in the outer surface of said pipe.

2. A control valve for a variable capacity compressor, wherein coolant pressure control is performed by means of the control valve that comprises a solenoid exciting section including a plunger and coolant that is sucked in from a suction chamber through a suction conduit is compressed and delivered into a delivery chamber through a delivery conduit;

said control valve comprises a control valve main body, the solenoid exciting section for controlling the coolant pressure within the crank chamber and a pressure-sensitive section, said solenoid exciting section is arranged in a position at the bottom of the control valve, said pressure-sensitive section is arranged inside the solenoid exciting section and, in addition, said control valve main body is arranged at the top of the solenoid exciting section;

opening/closing control of a gas supply valve body arranged in a first fluid communication path between said delivery conduit and said crank chamber and of an extraction valve body arranged in a second fluid communication path between the crank chamber and the suction conduit is performed in accordance with the balance of the attractive force of said solenoid exciting section, the reaction of a bellows and the suction coolant pressure;

said control valve main body is a tubular body extending in the vertical direction and is formed with a gas supply valve chamber that communicates with a crank chamber communicating port, a gas supply valve hole, a delivery communication port, a valve rod support section, an extraction valve chamber communicating with the crank chamber communicating port, and a plunger chamber communicating with a suction communicating port, along an axis, within the tubular body thereof;

a valve rod that is elongate in the vertical direction is arranged in the internal space of said tubular body, and the valve rod comprises a unitary body comprising the gas supply valve body arranged in the gas supply valve chamber, a reduced-diameter section formed at said gas supply valve hole and the delivery communication port and a support receiving section that is supported at said valve rod support section, and an extraction valve body guide section that is connected to said plunger and positioned within said extraction valve chamber;

said extraction valve body is slidably fitted into said extraction valve body guide section and arranged biased towards said unitary body side and is located in position by means of an extraction valve plate; and said extraction valve body is formed with at least one groove that allows fluid communication between the suction communication port and the crank chamber communication port and the rate of flow of coolant through said at least one groove is controlled by the vertical position of said extraction valve body with respect to said extraction valve body guide section, wherein the extraction valve body is formed in pipe shape and said at least one groove is formed as an internal groove in the inner surface of said pipe and an external groove in the outer surface of said pipe, and wherein said extraction valve body is formed with respective flange-shaped flats at the upper and lower edges of the pipe, the circumferential section of the flat that is formed at the upper edge of the pipe being in sliding contact with the side wall of said extraction valve chamber, and the upper surface of the flat that is formed at the lower edge of the pipe being constructed so as to abut the inside wall surface of the suction communication port when the extraction valve is raised.

* * * * *